United States Patent [19]

Hull

[11] Patent Number: 4,878,371

[45] Date of Patent: Nov. 7, 1989

[54] REALIGNMENT TOOL FOR APERTURE MATING SURFACE

[76] Inventor: Robert W. Hull, 2915 E. Mulberry, Phoenix, Ariz. 85040

[21] Appl. No.: 687,779

[22] Filed: Dec. 31, 1984

[51] Int. Cl.[4] ..... B21D 9/05

[52] U.S. Cl. ..... 72/390; 29/259

[58] Field of Search ..... 72/390, 454, 705; 29/256, 259, 283.5

[56] References Cited

U.S. PATENT DOCUMENTS

| | | | |
|---|---|---|---|
| 1,060,872 | 5/1913 | Wilson | 29/259 X |
| 1,847,943 | 3/1932 | Griffin | 72/390 |
| 2,863,489 | 12/1958 | Priest | 72/390 |
| 2,941,429 | 6/1960 | Mason | 72/705 X |
| 3,878,709 | 4/1975 | Chartier | 72/705 X |
| 4,089,201 | 5/1978 | Raptis | 72/390 |

*Primary Examiner*—Judy J. Hartman

*Attorney, Agent, or Firm*—Richard R. Mybeck

[57] ABSTRACT

A tool for realigning a warped aperture mating surface of a flanged oil sump comprising a flange engaging yoke, a force member, and an aperture engaging member coacting with said yoke and said force member to realign said warped surface.

5 Claims, 1 Drawing Sheet

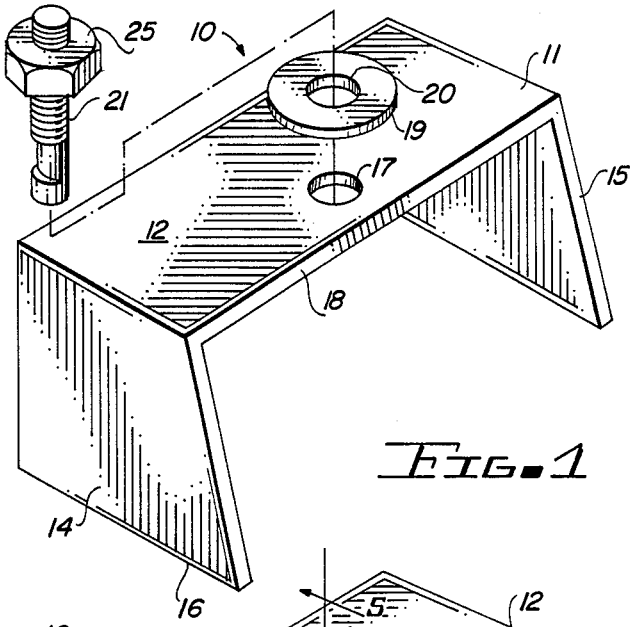
FIG. 1
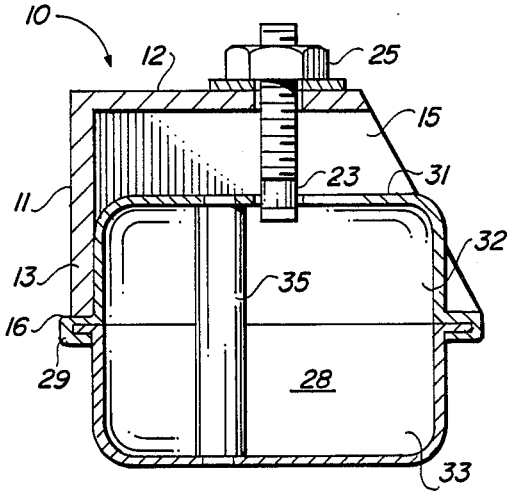
FIG. 3
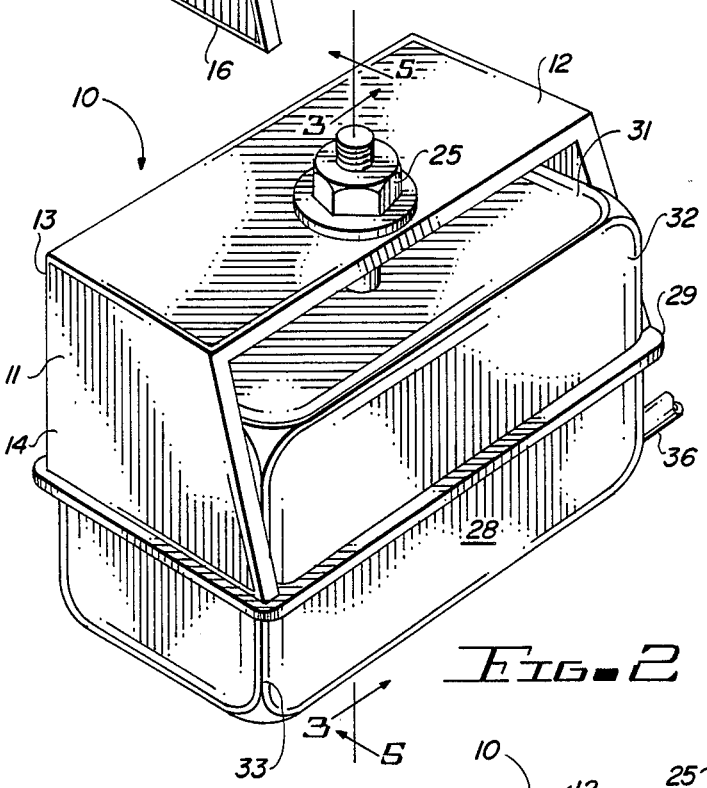
FIG. 2
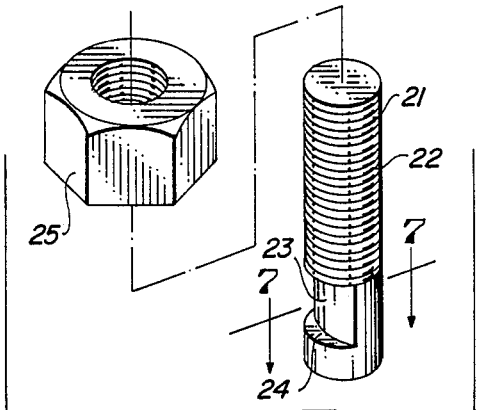
FIG. 6
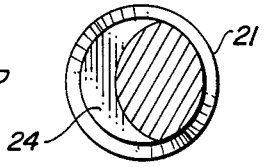
FIG. 7
FIG. 5
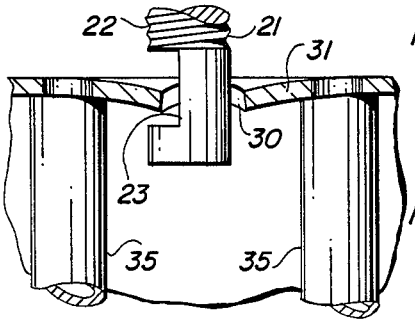
FIG. 4
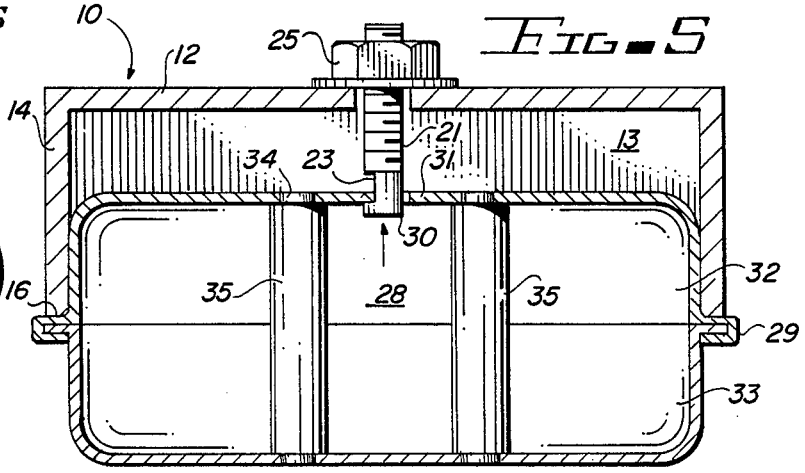

REALIGNMENT TOOL FOR APERTURE MATING SURFACE

This invention relates generally to tools and, more specifically, to a tool for realignment of an aperture mating surface upon a flanged oil sump.

BACKGROUND OF INVENTION

The oil sump externally attached to certain types of jet aircraft engines, such as the Allison Turbine Series 250-C20, is a chamber constructed of two concave portions joined together by a protruding circumferential seam or flange, and having a substantially flat mating surface through which an oil inlet aperture and several offset bolt holes extend. The oil sump, or flanged chamber, is mated to the engine by tightening several bolts therethrough. Overtightening of these bolts frequently deforms or misaligns the normally flat chamber mating surface and spoils oil sealing integrity at the mating surface.

In the past, these oil sump chambers when misaligned were either discarded or they were repaired by an expensive welded buildup with subsequent hand grinding to restore the mating surface surrounding the inlet aperture to a flat level condition.

Typical misalignment urges the mating surface inward; however the chamber interior is relatively inaccessible to outwardly-pushing type surface realignment tools. Thus a need exists for a realignment tool which is capable of restoring a misaligned sump mating surface to its original normally flat condition without deforming either the adjacent aperture or the oil sump surface to which opposing force is transmitted.

SUMMARY OF INVENTION

The present invention is directed to a tool comprising in combination a yoke adapted to straddle a mid-flanged oil sump having a warped mating surface in supported relationship to the flange integrally formed with the sump and aperture engagement means which coact with the yoke and the oil-inlet aperture and, in response to force means operatively interposed between the aperture engagement means and the yoke, draws the mating surface back into its original substantially flat realignment. The aperture engagement means is provided with a notch means which coacts with a portion of the mating-surface- surrounded aperture to exert realignment forces thereupon.

In a preferred embodiment of the present invention, a yoke is created from a quasi-box-like structure having a top, two sides and a back. The lower extremities of the back and sides seat upon the oil sump flange, and the aperture engagement means operatively coacts with the sump aperture surrounded by the deformed mating-surface to draw the deformed surface into its required planar shape. Realignment force can be provided by suitable means such as a nut threadedly engaged with the engagement means which generates force through the aperture engaging means to the warped mating surface in opposition to the force exerted through the yoke upon the oil sump flange.

Accordingly, a prime object of the present invention is to provide a tool permitting the ready and inexpensive realignment of the aperture mating surface of a flanged oil sump.

Another object of the present invention is to provide a tool for permitting the ready and inexpensive realignment of the aperture mating surface of a flanged oil sump without creating undesired mechanical deformation of portions of the oil sump beyond the mating surface.

A further object of the present invention is to provide a tool for realigning a deformed aperture mating surface of a flanged oil sump which obtains the desired realignment without creating undesired mechanical deformation of the surfaces associated therewith.

A still further object of the present invention is to provide a tool for realignment of an aperture mating surface upon a flanged oil sump capable of gradual, controlled application of realignment force for accurate approach and achievement of a desired degree of aperture mating surface planarity.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

IN THE DRAWING

FIG. 1 is an exploded isometric view of a realignment tool embodying the present invention.

FIG. 2 is an isometric view of the realignment tool of FIG. 1 operatively disposed upon an aircraft engine oil sump having a deformed mating surface.

FIG. 3 is a cross-section taken along line 3—3 of FIG. 2.

FIG. 4 is an enlarged fragmented view of a warped aircraft engine oil sump mating surface portion prior to engagement by the aperture engagement means embodied in the present invention.

FIG. 5 is a cross-section taken along line 5—5 of FIG. 3.

FIG. 6 is an exploded view of aperture engagement means and force means embodying the present invention.

FIG. 7 is a cross-section taken along line 7—7 of FIG. 6.

DESCRIPTION OF PREFERRED EMBODIMENT

Referring to the drawing, a realignment tool embodying the present invention is generally designated at 10. As shown in FIGS. 1 and 3, each tool 10 comprises a yoke member 11 formed of an upper rectangular plate 12 having a rectangular backplate 13 integrally formed therewith and extending normal therefrom. Trapezoidal shaped side plates 14, 15 are respectively secured to each end of top plate 12 and backplate 13 at generally right angles thereto and coact therewith to provide yoke 11 with a flange engaging surface 16 which is formed by the lower edges of plates 13, 14 and 15.

An aperture 17 is strategically disposed through upper plate 12 adjacent the leading edge 18 thereof and is overlaid by an annular member 19 having an opening 20 which, as will appear, is disposed in registry with aperture 17 in the operation of tool 10.

A cylindrical member 21 having a threaded outer surface 22 in which an engagement notch 23 is defined axially therein to provide a crescent-shaped bearing surface 24 at the bottom thereof. Suitable force generating means such as nut 25 coacts with member 21 to selectively move surface 24 toward and away from means 25 when means 25 is in a stationary position.

Cylindrical member 21 is provided with a diameter which enables member 21 to readily pass through opening 20 and aperture 17 for a purpose to be hereinafter described in detail.

Referring now to FIG. 2, the realignment tool 10 is shown in operative association with a damaged aircraft engine oil sump generally referred to as 28, with flange engaging surface 16 seated upon circumferential flange 29 of oil sump 28 so that opening 19 and aperture 17 are in proximate coaxial relationship with aperture 30 of oil sump 28.

As more clearly shown in FIGS. 3, 4 and 5, aperture engagement means 21 coacts with aperture 30 to draw warped aperture mating surface 31, see FIG. 4, upwardly into a substantially flat condition, by rotating nut-type forcing means 25 on threaded surfaces 22 to draw member 21 through aperture 17 and engage to plate 12 with washer 19 and force means 25 whereupon opposing downward force is distributed along a substantial portion of flange 26 through engagement of flange engaging surface 16 of plates 13,14, and 15 while simultaneously drawing surface 31 upwardly by its engagement with surface 24.

FIGS. 3 and 5 show a typical oil sump 28, comprising upper pan-like portion 32 having mating surface 31 surrounding oil inlet aperture 30, and a lower pan-like portion 33, sealingly secured to upper portion 32 by flange 29. A plurality of bolt holes 34 extend through upper portion 32, lower portion 33 and tubular columns 35, displaced from the central axis of aperture 30 as shown in FIG. 3.

When oil sump 28 is in use, it is attached to a jet aircraft engine at substantially flat mating surface 31 by means of bolts (not shown) which pass through offset bolt holes 34 and columns 35. Overtightening of these bolts causes warpage of mating surface 31 as shown in FIG. 4. To restore mating surface 31 to its required degree of planarity, aperture engagement means 21 is inserted through aperture 17, opening 20 and aperture 30 and displaced laterally until surface 24 of notch means 23 engages the lower surface of mating surface 31 and forcing means 25 is tightened as described to draw cylindrical member 21 and, hence mating surface 31, in an upward direction.

Appendages, vents, drains, outlets and the like, such as exemplified by outlet 36 of FIG. 2, which protrudes from lower portion 33 of oil sump 28, remain undisturbed during restoration of mating surface 31 by realignment tool 10, because all force transmission through flange 29 is accomplished from above the lower portion 33.

FIGS. 6 and 7 further illustrate the apertureconformal shape of engagement notch means 23 and show that the diameter of aperture engagement means 21 is sufficiently smaller than the diameter of aperture 30 to permit ready passage therethrough. The crescent shaped surface 24 of engagement notch means 23 will preferrably have a notch radius which is approximately equal to the radius of aperture 30. Thus as shown in FIGS. 6 and 7, engagement notch means 23 provides an engagement surface 24 having a relatively strong tensile cross-section.

In other embodiments of the present invention, other means may be employed such as a so-called hydraulic jack which permit a readily controllable force in drawing member 21 upwardly relative to plate 12 and straighten surface 31.

From the foregoing, it is apparent that a device has been herein described and illustrated which fulfills all of the aforestated objectives in a remarkably unexpected fashion. It is of course understood that such modifications, alterations and adaptations as may readily occur to the artisan confronted with this disclosure are intended within the spirit of this disclosure which is limited only by the scope of the claims appended hereto.

What is claimed is:

1. A tool for realigning a warped aperture mating surface upon a mid-flanged oil sump to facilitate its external attachment to a jet aircraft engine, said tool comprising: a yoke member having a top plate defining a first plane and having an aperture defined therethrough, a back plate and a first and second side plate, said back plate and said side plates being secured to said top plate in generally normal relationship thereto and depending therefrom to define a flange engaging surface for engaging the mid flange of said sump in a second plane disposed in generally parallel spaced relationship to said first plane, said back plate being operatively interposed between said side plates in supporting relationship thereto; an aperture engaging means having a cylindrical body portion threaded at one end thereof and having a notch defined therein to define a crescent supporting surface therewith adjacent the other end thereof for engagement with the warped aperture in said mating surface in a third plane intermediate said first plane and said second plane; and force means operatively associated with said aperture engaging means and actuatable upon said threaded body portion to selectively move said crescent supporting surface and hence said warped aperture mating surface engaged therewith toward and away from said top plate in response thereto until said third plane is placed in substantially parallel planar relationship to said first and said second planes.

2. A tool according to claim 1 in which said aperture engaging means coacts with said yoke means in response to said force means to exert force therethrough between said flange and said aperture mating surface.

3. A tool according to claim 2 in which said force means comprises an annular member circumscribing said aperture engagement means in superpositioned engagement with said top plate and threaded nut means secured to said threaded body portion and operative therewith to axially move said body portion relative to said nut means.

4. A tool according to claim 1, actuatable, when disposed upon a mid-flanged oil sump having a warped aperture mating surface, to align said warped surface in response to the force applied to said force means after engaging said warped surface with said crescent supporting surface and drawing said supporting surface upwardly in response to said force means.

5. A tool according to claim 3 in which said side plates are of trapezoidal configuration extending from a narrower upper edge to a wider lower edge of a dimension substantially equal to said sump flange.

* * * * *